US006308624B1

(12) United States Patent
Sugiya et al.

(10) Patent No.: US 6,308,624 B1
(45) Date of Patent: Oct. 30, 2001

(54) METHOD OF PRODUCING A COMPRESSIBLE LAYER FOR A PRINTING BLANKET

(75) Inventors: Makoto Sugiya, Sakurai; Toshio Kamada, Akashi; Seiji Tomono, Kobe; Yuji Yamasaki, Kakogawa, all of (JP)

(73) Assignee: Sumitomo Rubbers Industries, Limited, Hyogo (JP)

( * ) Notice: Subject to any disclaimer, the term of this patent is extended or adjusted under 35 U.S.C. 154(b) by 0 days.

(21) Appl. No.: 09/395,375

(22) Filed: Sep. 14, 1999

(30) Foreign Application Priority Data

Sep. 14, 1998 (JP) ..... 10-260299
May 18, 1999 (JP) ..... 11-137479

(51) Int. Cl.[7] ..... B41N 10/04; B41C 1/06

(52) U.S. Cl. ..... 101/401.1; 427/389.9; 428/909; 428/284; 264/257

(58) Field of Search ..... 101/216, 217, 101/375, 376, 483, 492, 493, 401.1; 428/909, 284, 286, 290, 313.5; 29/895, 895.21; 492/49, 51, 52, 53, 56; 427/389.9; 264/257, 258

(56) References Cited

U.S. PATENT DOCUMENTS 2,797,201 6/1957 Veatch .
4,042,743 8/1977 Larson .
4,471,011 * 9/1984 Spöring ..... 428/909
4,770,928 9/1988 Gaworowski .

FOREIGN PATENT DOCUMENTS

0342286B1 11/1989 (EP) .
1327758 8/1973 (GB) .
2241241 8/1991 (GB) .
61-52800 11/1986 (JP) .
62-286534 12/1987 (JP) .
3-244595 10/1991 (JP) .
6-1091 11/1994 (JP) .
93 18913 9/1993 (WO) .

* cited by examiner

*Primary Examiner*—Leslie J. Grohusky
(74) *Attorney, Agent, or Firm*—Birch, Stewart, Kolasch & Birch, LLP

(57) ABSTRACT

A method is furnished for producing a compressible layer for a printing blanket by heating a sheet-shaped intermediate layer of a rubber composition having a structure in which hollow microspheres are dispersed in matrix rubber for one to fifty minutes under certain defined conditions of vulcanizing pressure and temperature using a vulcanizer for applying heat and pressure in direct contact with the intermediate layer. The produced compressible layer exhibits superior compressibility and durability, is uniform in thickness and internal structure, and does not reduce the productivity of the printing blanket and increase the fabrication cost of the printing blanket.

8 Claims, 1 Drawing Sheet

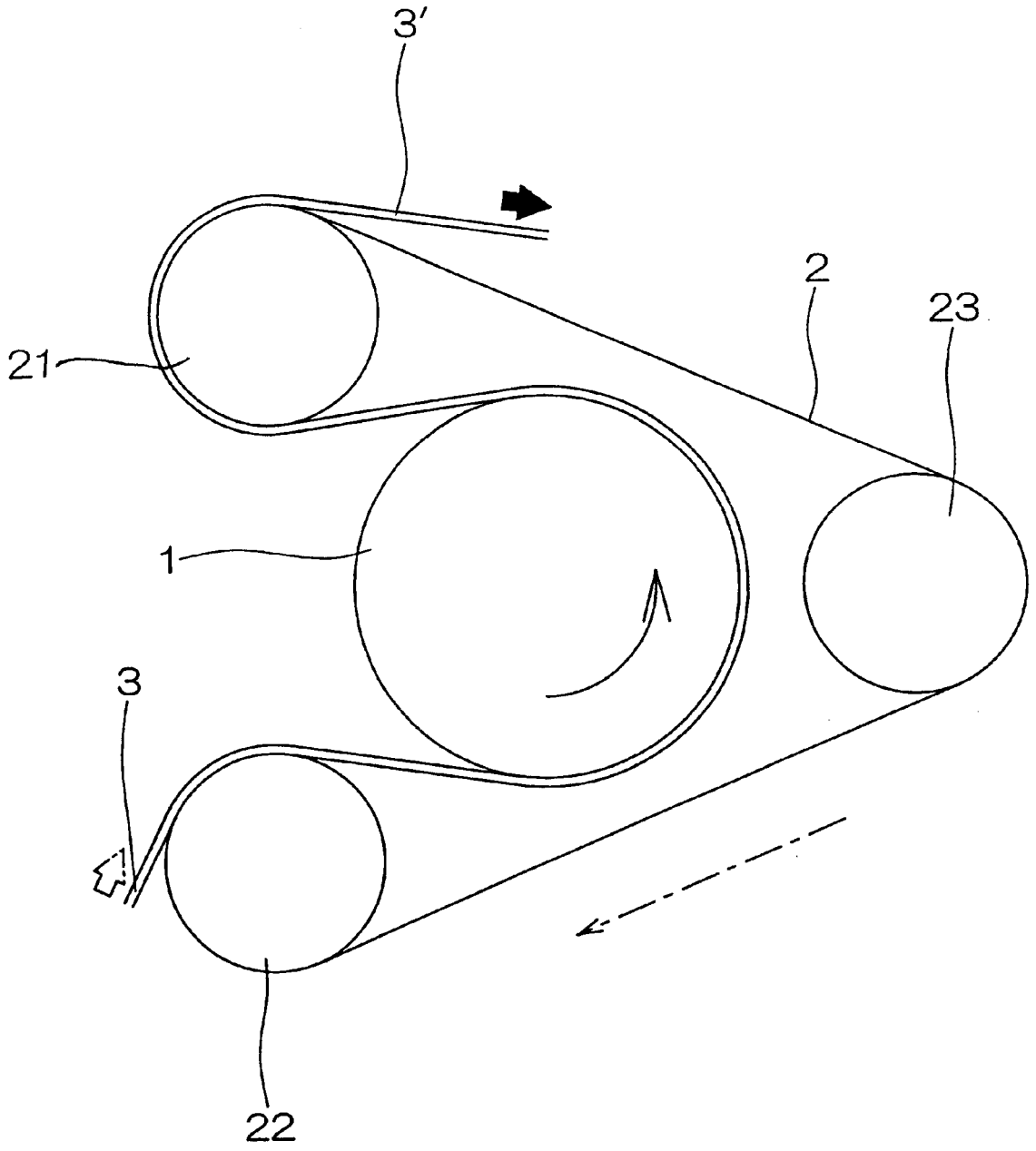
3′
2
23
21
1
3
22

METHOD OF PRODUCING A COMPRESSIBLE LAYER FOR A PRINTING BLANKET

BACKGROUND OF THE INVENTION

1. Field of the Invention

The present invention relates to a compressible layer for a printing blanket, made of vulcanized rubber and having a porous structure, which is incorporated into a printing blanket and a method of producing the same, and a printing blanket incorporating the compressible layer for a printing blanket.

2. Description of the Prior Art

In recent years, a so-called air-type printing blanket in which a compressible layer composed of an elastomer such as rubber and having a porous structure is provided under a surface printing layer similarly composed of an elastomer such as rubber has widely spread.

The air-type printing blanket is lower in compressive stress in a nip deformed portion produced by being pressed against a plate cylinder or the like, and is superior in impact absorbability because a variation in the compressive stress caused by the change in the amount of distortion is smaller, as compared with conventional solid-type printing blanket having no compressible layer. Therefore, the air-type printing blanket is superior in the effect of preventing impact produced at the time of feeding gears of a printing press, for example, from adversely affecting printing precision.

The solid-type printing blanket causes so-called bulge by stress concentrations on the surface printing layer in the nip deformed portion, which might result in inferior printing such as out of register, inferior paper feeding, double, or deformation of a dot pattern due to expansion in the circumferential direction. On the other hand, the air-type printing blanket can also prevent the inferior printing because the compressible layer has the function of lowering stress concentrations on the surface printing layer.

The following have been conventionally known as the above-mentioned compressible layer having a porous structure in the air-type printing blanket:

1̂ a compressible layer having an open cell structure, which is formed by a so-called leaching method for forming in a layered shape matrix rubber having common salt particles dispersed herein, vulcanizing the matrix rubber, and then extracting the common salt particles with warm water or the like, and 2̂ a compressible layer having a closed cell structure, which is formed by forming in a layered shape matrix rubber having a foaming agent which is decomposed by heating, for example, to emit gas dispersed therein, and foaming the foaming agent simultaneously with the vulcanization of the matrix rubber by heating at the time of the vulcanization.

The latter compressible layer having a closed cell structure has been paid attention to in recent years because it is superior in durability or the like to the former compressible layer.

The compressible layer having a closed cell structure makes it difficult to control the foaming of the foaming agent. Accordingly, the size of each of closed cells to be formed varies, or a plurality of cells communicate with each other in the foaming process to form a huge void. As a result, the cell structure of the compressible layer is non-uniform, so that compressibility varies, which adversely affects printing properties.

In order to solve this problem, it has been examined that hollow microspheres each having gas sealed in its spherical shell made of thermoplastic resin are used, to form a compressible layer having a closed cell structure. The hollow microspheres are supplied with their shapes and their particle diameters made nearly uniform. Therefore, it is considered that if matrix rubber having the hollow microspheres dispersed therein is formed in a layered shape, and is vulcanized, a compressible layer which has a uniform cell structure and do not vary in compressibility is obtained.

In the above-mentioned construction, however, it becomes clear that if the matrix rubber is vulcanized by applying heat and pressure under the conventional conditions using the conventional curing pan, for example, a compressible layer having sufficient compressibility is not obtained.

Specifically, the shells made of thermoplastic resin as described above are softened or melted by applying heat for a long time in vulcanizing the matrix rubber, and the hollow microspheres are deformed or collapsed by applying pressure in vulcanizing the matrix rubber. Therefore, a uniform closed cell structure with a sufficient porosity is not formed in the compressible layer, resulting in degraded compressibility of the compressible layer.

It has been examined that the matrix rubber is vulcanized without deforming or collapsing the hollow microspheres, and various proposals have been carried out.

For example, U.S. Pat. No. 4,770,928 (EP 0 342 286 B1) discloses a method of forming a compressible layer by holding matrix rubber, formed in a layered shape, having hollow microspheres dispersed therein over a long time period of 1 to 12 hours at a temperature of approximately 43 to 77° C. which is significantly lower than the deforming temperature of the hollow microspheres to subject the matrix rubber to primary vulcanization without deforming or collapsing the hollow microspheres.

According to this method, in the subsequent step of laminating the compressible layer with the other layers constituting a printing blanket and finally subjecting an obtained laminate to secondary vulcanization to fabricate the printing blanket, even if a shell of each of the hollow microspheres is softened or melted or is lost upon being compatible with the matrix rubber by applying high temperature and high pressure as in the conventional example, the matrix rubber around the hollow microsphere which has already been vulcanized to some extent at the time of the previous primary vulcanization maintains the shape of a void where the hollow microsphere has existed. Therefore, it is possible to fabricate a printing blanket comprising a compressible layer having a high porosity and exhibiting uniform and superior compressibility.

In this method, however, a significantly long time period is required, as described above, to subject the matrix rubber to the primary vulcanization. Therefore, the productivity of the compressible layer and therefore, the productivity of the printing blanket are significantly lower than before. In order to subject the matrix rubber to the primary vulcanization at a significantly low temperature, as described above, a special vulcanization accelerator which is referred to as an ultra-accelerator must be generally used. Therefore, the fabrication cost of the printing blanket is high.

In the above-mentioned publication, a term "melting point of microcapsules (hollow microspheres)" is used with respect to the deforming temperature of the hollow microspheres. However, the thermoplastic resin such as a copolymer of acrylonitrile and vinylidene chloride, for example, which is exemplified in the publication has no definite melting point, as is well known. Accordingly, this term is unclear.

According to the examination by the inventors, the lowest temperature at which there occurs such a phenomenon that in heating the hollow microspheres, for example, for a predetermined time period (for example, approximately thirty minutes) under atmospheric pressure, for example, in an oven kept at a predetermined temperature, their shells are softened or melted during the above-mentioned time period,, so that many of the hollow microspheres are aggregated or integrated by fusing almost coincides with "melting point" in the above-mentioned publication or "melting temperature" in the following two prior arts. In the present specification, therefore, the heat resisting temperature of the hollow microspheres shall be represented by the deforming temperature of the hollow microspheres, as described above, and more specifically, the deforming temperature in a case where the hollow microspheres are heated under atmospheric pressure without applying pressure.

JP-A-3-244595 discloses, as an improvement of the above-mentioned publication, a method of bringing a layer of matrix rubber into contact with a drum which is warmed to a temperature which is as high as possible in temperatures lower than the deforming temperature of hollow microspheres (not more than approximately 100° C. in the specification) or suspending the layer of the matrix rubber in an atmosphere which is warmed to the above-mentioned temperature to vulcanize the matrix rubber. It is disclosed that by employing such a method, the vulcanizing time can be shortened, as compared with that in a case where the layer of the matrix rubber is merely left to vulcanize the matrix rubber.

From the above-mentioned publication disclosing that the vulcanizing time which is one week at room temperature can be shortened, which is not definite because the degree to which the vulcanizing time can be shortened by employing this method is not specifically described, it is expected that a time period of one to tens of hours is required to vulcanize a compressible layer even if the vulcanizing time can be shortened. If so, it is considered that the problem that the productivity of the compressible layer and therefore, the productivity of the printing blanket is low remains unresolved.

In the above-mentioned method, the vulcanizing temperature is still a low temperature of not more than 100° C. Therefore, the above-mentioned ultra-accelerator ("a strong material for vulcanizing rubber at a temperature of not more than 100° C." described in the above-mentioned publication is a ultra-accelerator) must be used as a vulcanization accelerator. Therefore, the problem that the fabrication cost of the printing blanket which is based on the use of the ultra-accelerator is high remains unresolved.

In order to solve the problems, it has been proposed in WO 93/18911 A1 that hollow microspheres having high heat resistance whose deforming temperature is not less than 135° C. are used, and the primary vulcanizing temperature of matrix rubber is set to a temperature lower than the deforming temperature of the hollow microspheres but slightly higher than before, for example, approximately 80 to 150° C.

As the effect, the publication discloses that the primary vulcanizing time can be reduced to one to six hours, and the compressible layer can be formed using a general-purpose vulcanization accelerator without using the above-mentioned special ultra-accelerator.

Even in the above-mentioned method, however, the vulcanizing time is still a long time of not less than one hour. Therefore, the quantity of heat applied to the hollow microspheres during the vulcanization is large, and the primary vulcanizing temperature of the matrix rubber and the deforming temperature of the hollow microspheres are close to each other. Therefore, it has been made clear by the examination by the inventors that at the time of actual vulcanization, vulcanization reaction of the matrix rubber, the deformation or collapse of the hollow microspheres by softening or melting their shells progress almost simultaneously and competitively.

In a case where a compressible layer is subjected to primary vulcanization by a method in which the quantity of heat received by a layer of matrix rubber having hollow microspheres dispersed therein which forms the basis of the compressible layer, for example, may greatly vary as in a case where the layer of the matrix rubber, together with one base fabric for supporting the layer, is wound in a roll shape, and is vulcanized in a curing pan, a portion where the hollow microspheres have already been deformed or collapsed, although the matrix rubber around the hollow microspheres is sufficiently vulcanized or a portion where the matrix rubber around the hollow microopheres is insufficiently vulcanized, although the hollow microspheres are not deformed or collapsed, and the hollow microspheres are deformed or collapsed at the time of secondary vulcanization which is the subsequent step occur in the compressible layer. As a result, the porosity of the compressible layer in the printing blanket greatly decreases and varies from place to place. Therefore, it has been clear that the compressibility may be degraded.

SUMMARY OF THE INVENTION

A primary object of the present invention is to provide a new compressible layer for a printing blanket which exhibits superior compressibility and superior durability because it has a uniform closed cell structure and may not reduce the productivity of a printing blanket and increase the fabrication cost thereof because it can be fabricated in a short time and efficiently and it does not require a special compound such as a ultra-accelerator.

Another object of the present invention is to provide a new method of producing such a compressible layer for a printing blanket.

Still another object of the present invention is to provide a new printing blanket incorporating the above-mentioned compressible layer for a printing blanket.

In order to attain the above-mentioned object, the inventors have paid attention to a vulcanizer, comprising a member for applying heat and pressure in direct contact with a thin member to be vulcanized, having a predetermined thickness, of a sheet shape, for example, which can be vulcanized in a shorter time than that in the conventional example.

As a result of giving repeated consideration in order to find out vulcanization conditions under which only matrix rubber can be vulcanized without requiring the above-mentioned special compound such as the ultra-accelerator and deforming or collapsing almost all of hollow microspheres using the above-mentioned vulcanizer, the present invention has been completed.

Specifically, a compressible layer for a printing blanket according to the present invention is produced by heating a sheet-shaped intermediate member including a layer of a rubber composition having a structure in which hollow microspheres each having a shell made of thermoplastic resin are dispersed in unvulcanized matrix rubber for one to fifty minutes under the following conditions of vulcanizing pressure Pv [kgf/cm$^2$] and vulcanizing temperature Tv (° C.) using a vulcanizer comprising a member for applying heat and pressure in direct contact with the intermediate member, to vulcanize the matrix rubber in the layer of the rubber composition:

$$0<Pv\leqq 3.0kgf/cm^2$$

$$Td\leqq Tv\leqq Td+50°\ C.$$

[In the equation, Td is deforming temperature (° C.) in a case where the hollow microspheres are heated under atmospheric pressure without applying pressure.]

A method of producing a compressible layer for a printing blanket according to the present invention is characterized by comprising the steps of:

(1) dispersing hollow microspheres each having a shell made of thermoplastic resin in unvulcanized matrix rubber, to produce a rubber composition;

(2) laminating the rubber composition on at least one base fabric, to form a sheet-shaped intermediate member;

(3) heating the intermediate member for one to fifty minutes under the following conditions of vulcanizing pressure Pv [kgf/cm$^2$] and vulcanizing temperature Tv (° C.) using a vulcanizer comprising a member for applying heat and pressure in direct contact with the intermediate member, to vulcanize the matrix rubber in a layer of the rubber composition:

$$0<Pv\leqq 3.0kgf/cm^2$$

$$Td\leqq Tv\leqq Td+50°\ C.$$

[In the equation, Td is deforming temperature (° C.) in a case where the hollow microspheres are heated under atmospheric pressure without applying pressure.]

The printing blanket according to the present invention is characterized by being formed by laminating the compressible layer for a printing blanket in the present invention with the other layers constituting the printing blanket, and vulcanizing the whole of an obtained laminate.

According to the present invention, the compressible layer for a printing blanket is formed only by vulcanizing the sheet-shaped intermediate member including the layer of the unvulcanized rubber composition for one to fifty minutes which is significantly shorter than before under the particular conditions of vulcanizing pressure Pv and vulcanizing temperature Tv using the vulcanizer comprising the member for applying heat and pressure in direct contact with the intermediate member, as described above.

In the vulcanization for a short time, such a phenomenon that hollow microspheres are deformed or collapsed by softening or melting the shells, as in the conventional example hardly progresses. Accordingly, the formed compressible layer for a printing blanket exhibits uniform and superior compressibility.

The compressible layer for a printing blanket is also superior in durability to the conventional one having an open cell structure because it has a closed cell structure formed by a lot of hollow microspheres, as described above.

The compressible layer for a printing blanket is efficiently produced by the above-mentioned vulcanization for a short time. Therefore, the productivity of the printing blanket may not be reduced. Further, the productivity can be improved, as compared with that in the conventional example.

Moreover, the above-mentioned vulcanization is performed at a relatively high temperature which is not less than the deforming temperature Td (° C.) in a case where the hollow microspheres are heated under atmospheric pressure without applying pressure and is not more than a temperature higher by 50° C. than the deforming temperature Td (° C.), as described above. The necessity of the special compound such as the ultra-accelerator is eliminated. Therefore, the fabrication cost of the printing blanket may not be increased.

The foregoing and other objects, features, aspects and advantages of the present invention will become more apparent from the following detailed description of the present invention when taken in conjunction with the accompanying drawings.

BRIEF DESCRIPTION OF THE DRAWING

The FIG. 1 is a front view showing a continuous vulcanizer, as an example of a vulcanizer, comprising a member for applying heat and pressure in direct contact with an intermediate member, which is used when a compressible layer for a printing blanket according to the present invention is produced.

DETAILED DESCRIPTION OF THE INVENTION

Description is now made of the present invention.

A compressible layer for a printing blanket according to the present invention will be described on the basis of a method of producing the same.

In the present invention, a layer of a rubber composition having a structure in which hollow microspheres are uniformly dispersed in unvulcanized matrix rubber, which forms the basis of the compressible layer for a printing blanket is first laminated on a base fabric, to produce a sheet-shaped intermediate member.

The sheet-shaped intermediate member is formed in a suitable size and in a suitable shape.

For example, the intermediate member may be previously formed to a predetermined length corresponding to the size of one printing blanket.

When a continuous vulcanizer is used as the vulcanizer, the continuous vulcanizer is a device capable of continuously vulcanizing a member to be vulcanized irrespective of its length. If the productivity of the compressible layer for a printing blanket and the productivity of the printing blanket, for example, are considered, therefore, it is preferable that the intermediate member is formed in a longitudinal sheet shape corresponding to a succession of a lot of printing blankets.

The longitudinal intermediate member is produced as follows, for example:

1̂ continuously applying a rubber cement obtained by melting the rubber composition in a suitable solvent such as toluene or methyl ethyl ketone on a base fabric in a longitudinal strip shape with vulcanization adhesives applied therebetween or directly using a knife coater, a roll coater, a spray coater, a flow coater, and so forth, followed by drying, or 2̂ continuously immersing a base fabric in a longitudinal strip shape, then pulling the base fabric up from the rubber cement, and drying the base fabric, as described in FIG. 1 in JP-A-59-14995, for example.

Various types of rubber are listed as the matrix rubber composing the rubber composition. Particularly when resistance to ink, a wash liquid, or the like is considered, however, rubber having superior oil resistance is preferable. Examples of such oil-resistant rubber include acrylonitrile-butadiene copolymer rubber (NBR), choroprene rubber (CR), urethane rubber (U), and acrylic rubber (ACM), which are not limitations.

As the hollow microspheres, it is possible to use any of various types of conventionally known hollow microspheres each having a shell made of thermoplastic resin, which are disclosed in the above-mentioned U.S. Pat. No. 4,770,928 (EP 0 342 286 B1) JP-A-3-244595, WO 93/18913 A1, and so forth.

Particularly, with the considerations of oil resistance to printing ink, a homopolymer of polymeric monomers such as vinylidene chloride or (meta)acrylonitrile, a copolymer obtained by copolymerizing two or more monomers containing at least one of the polymeric monomers, and so forth are preferable.

The particle diameter of the hollow microspheres is not particularly limited. In order to form a uniform closed cell structure to give good compressibility to the compressible layer for a printing blanket, however, it is preferable that the average particle diameter of the hollow microspheres is approximately 10 to 200 $\mu$m. In the case of hollow microspheres, which have not been foamed yet, described later, the particle diameter thereof is the particle diameter of the hollow microspheres which have been foamed by heating.

Specific examples of the hollow microsphere include a hollow microsphere in EXPANCEL SERIES available from Nobel Co., Ltd. and a hollow microsphere available from Matumoto Yushi Co., Ltd. Supplied as each of the hollow microspheres are ones, which have not been foamed yet, each having an organic solvent which forms the basis of a void sealed in its shell made of thermoplastic resin, and ones, which have already been foamed, each having a void formed in its shell upon vaporizing the organic solvent by heating. In the present invention, either the former hollow microspheres or the latter hollow microspherea can be used.

When the former hollow microspheres which have not been foamed yet are used, it is preferable that the organic solvent in the shells is vaporized by heating, to expand the hollow microspheres to the above-mentioned particle diameter in any one of the following steps:

(1) before the hollow microspheres are dispersed in matrix rubber to form a rubber composition, (2) after the hollow microspheres are dispersed and before the rubber composition is laminated on the base fabric to vulcanize an obtained laminate, or (3) when the matrix rubber in a layer of the rubber composition is vulcanized.

Although the mixture ratio of the hollow microspheres in the rubber composition is not particularly limited, it is preferable that it is in the range of 20/80 to 80/20, and particularly in the range of 70/30 to 30/70 in terms of the volume ratio M/R of the hollow microspheres M in a foamed state to the matrix rubber R, considering the compressibility of the formed compressible layer for a printing blanket.

Ingredients for vulcanizing rubber such as a vulcanizing agent, a vulcanization accelerator, an activator, and a retarder are added, in addition to both the above-mentioned ingredients, to the rubber composition. In addition thereto, various additives such as an antioxidant, a reinforcer, a filler, a softener, and a plasticizer are added as required. The amount of the addition of each of the additives may be approximately the same as that in the conventional example. Although specific compounds of the additives will be exemplified later, the necessity of a special ultra-accelerator, as described above, as the vulcanization accelerator is eliminated, and a general-purpose vulcanization accelerator is suitably used, as described later. However, there is no reason why the ultra-accelerator is excluded except in terms of costs. If there arises no problem in terms of costs, therefore, the ultra-accelerator may be used.

As a base fabric on which the above-mentioned rubber composition is laminated, fabrics woven from cotton, polyester, rayon, or the like is used, as in the conventional example.

The intermediate member is vulcanized by being heated for one to fifty minutes under the following conditions of vulcanizing pressure Pv [kgf/cm$^2$] and vulcanizing temperature Tv (° C.) using a vulcanizer comprising a member for applying heat and pressure in direct contact with the intermediate member, as described above:

$$0<Pv\leqq 3.0\,kgf/cm^2$$

$$Td\leqq TV\leqq Td+50^\circ\ C.$$

[In the equation, Td is deforming temperature (° C.) in a case where the hollow microspheres are heated under atmospheric pressure without applying pressure.]

The deforming temperature Td (° C.) is defined by the lowest temperature at which there occurs such a phenomenon that when the hollow microspheres, for example, are heated for a predetermined time period (for example, approximately thirty minutes) under atmospheric pressure, for example, in an oven kept at a predetermined temperature, their shells are softened or melted during the above-mentioned time period, so that many of the hollow microspheres are aggregated or integrated by fusing.

In the present invention, the following is the reason why the vulcanizing pressure Pv in the vulcanization conditions is defined in the range of $0<Pv\leqq 3.0$ kgf/cm$^2$, as described above.

That is, when the vulcanizing pressure Pv exceeds 3.0 kgf/cm$^2$, the hollow microspheres are deformed or collapsed by such high pressure, so that the porosity of the compressible layer for a printing blanket greatly decreases and varies from place to place, resulting in degraded compressibility.

On the other hand, when the vulcanizing pressure Pv is 0 kgf/cm$^2$, that is, no vulcanizing pressure is applied, the hollow microspheres do not uniformly expand by heat at the time of vulcanization. Therefore, the internal structure of the compressible layer for a printing blanket is made non-uniform, so that the thickness thereof varies.

It is preferable that the vulcanizing pressure Pv is as small as possible in the above-mentioned range, that is, is not more than 0.2 kgf/cm$^2$ and particularly not more than 0.07 kgf/cm$^2$, considering that the variation in the thickness of the compressible layer, and the variations in the shape and the size, the dispersed state, and so forth of the hollow microspheres are restrained, to form a compressible layer for a printing blanket having a more uniform thickness and a more uniform internal structure.

Although the lower limit of the vulcanizing pressure Pv is not particularly limited from the above-mentioned reasons, it is approximately 0.01 kgf/cm$^2$, considering the limit of the pressure applying precision in a vulcanizer.

In the present invention, the following are the reason why the vulcanizing temperature Tv (° C.) in the vulcanization conditions is limited in the range of a temperature which is not less than the deforming temperature Td (° C.) in a case where the hollow microspheres are heated under atmospheric pressure to a temperature which is not more than a temperature higher by 50° C. than the deforming temperature Td (° C.), and the vulcanizing time is limited in the range of one to fifty minutes.

That is, when either one of the vulcanizing temperature Tv (° C.) and the vulcanizing time exceeds the above-mentioned range, the hollow microspheres are deformed or collapsed by applying heat at such a high temperature and for a long time. Accordingly, the porosity of the compressible layer for a printing blanket greatly decreases and varies from place to place, resulting in degraded compressibility.

On the other hand, when either one of the vulcanizing temperature Tv (° C.) and the vulcanizing time is less than the above-mentioned range, the matrix rubber is insufficiently vulcanized. Accordingly, there arises a place where the hollow microspheres are deformed or collapsed, for example, at the time of secondary vulcanization which is the subsequent step. As a result, the porosity of the compressible layer for a printing blanket greatly decreases and varies from place to place, resulting in degraded compressibility.

The vulcanizing temperature Tv (° C.) in the above-mentioned conditions is preferably in the range of $Tv \leqq Td+40°$ C. and more preferably in the range of $Tv \leqq Td+35°$ C. particularly in the above-mentioned range, considering that only the matrix rubber is vulcanized without deforming or collapsing almost all of the hollow microspheres, to form a compressible layer for a printing blanket which exhibits uniform and superior compressibility.

The vulcanizing temperature Tv (° C.) is preferably in the range of $Td+10° C. \leqq Tv$ and more preferably in the range of $Td+15° C. \leqq Td$ particularly in the above-mentioned range, considering that the compressible layer for a printing blanket is formed in a short time and efficiently.

The vulcanizing time is preferably not less than three minutes particularly in the above-mentioned range, considering that the matrix rubber is vulcanized reliably and uniformly. The vulcanizing time is preferably not more than forty minutes particularly in the above-mentioned range, considering the productivity of the compressible layer for a printing blanket.

As a vulcanizer for producing the compressible layer for a printing blanket by vulcanizing the sheet- shaped intermediate member under the above-mentioned vulcanization conditions, it is possible to use any of vulcanizers of various types comprising a member for applying heat and pressure in direct contact with the intermediate member and capable of vulcanizing the intermediate member under the above-mentioned conditions.

In order to apply pressure uniformly over the entire area in the range of the vulcanizing pressure Pv, a continuous vulcanizer, which is generally referred to as a Rote-Cure Type from the name of a device available from Adamson Co., Ltd. (U.S.) or an AUMA TYPE from the name of a device available from Berstorff Co., Ltd. (Germany), comprising a heat roller 1 which is rotated at a predetermined speed in a direction indicated by an arrow of a solid line and a endless belt 2 which is rotated in synchronization with the rotation of the heat roller 1 in a direction indicated by an arrow of a one-dot and dash line is suitably employed, as shown in the Figure, for example.

As the belt 2, it is possible to employ any of belts which are generally employed in the above-mentioned continuous vulcanizer, for example, a metal belt composed of a metal thin plate, a composite belt obtained by braiding a metal wire and coating its surface on the side of a product with heat-resisting rubber, or a belt made of vulcanized rubber which is reinforced by a base fabric.

In a region where the vulcanizing pressure Pv is low pressure of not more than 0.2 kgf/cm$^2$, as described above, when the above-mentioned conventional belts are employed, any of the belts is rigid along its thickness, that is, in the direction in which pressure is applied to the intermediate member. Accordingly, it is not easy to uniformly apply pressure with high precision, and the vulcanizing pressure varies. Particularly, the thickness of the compressible layer is liable to slightly vary.

In performing vulcanization when the vulcanizing pressure Pv is low pressure of not more than 0.2 kgf/cm$^2$, it is preferable to employ felt-like belts, for example, a felt belt produced by each type of producing method and its similar product in place of the above-mentioned conventional belts.

The felt-like belt has high flexibility and elasticity along its thickness. Particularly under the condition that the vulcanizing pressure Pv is low pressure of not more than 0.2 kgf/cm$^2$, therefore, pressure can be applied uniformly and with high precision. The felt-like belt is suited to produce a compressible layer for a printing blanket having a more uniform thickness and having a more uniform internal structure by restraining the variation in the thickness of the compressible layer and the variations in the shape and the size, the dispersed state, and so forth of the hollow microspheres, as described above.

As examples of the felt-like belt, it is possible to employ any of various types of felts such as a woven felt, a press felt, and a needle felt which are classified by a method of producing the same or an nonwoven fabric having an appearance similar to a felt.

A felt-like belt is one to which pressure is uniformly applied with high precision over the entire area of the above-mentioned range of the vulcanizing pressure Pv by having high flexibility and elasticity along its thickness, as described above. It is preferable that the specifications thereof are a thickness of approximately 3 to 20 mm, and a weight per unit area of approximately 500 to 10000 g/m$^2$.

Reference numerals 21 to 23 in the Figure denote rollers for rotating the belt 2 at a predetermined speed while pressing the belt 2 against the heat roller 1 at predetermined pressure, as described above.

In order to vulcanize a longitudinal sheet-shaped intermediate member 3 which has not been vulcanized yet, as described above, using the continuous vulcanizer shown in the Figure, the intermediate member 3 is first continuously inserted between the heat roller 1 and the belt 2 along its length, as indicated by a hollow arrow in the Figure.

As both the heat roller 1 and the belt 2 are rotated, therefore, the intermediate member 3 wound therebetween is continuously heated by heat generated by the heat roller 1 while being pressed at predetermined pressure by a pressing force of the belt 2 against the heat roller 1.

After the unvulcanized rubber composition in the intermediate member 3 is continuously vulcanized by the heating, so that the compressible layer 3' for a printing blanket made of vulcanized rubber is continuously formed, the compressible layer for a printing blanket is continuously discharged from a portion between the heat roller 1 and the belt 2, as indicated by a black arrow in the Figure.

When the continuous vulcanizer shown in the Figure is used, the vulcanizing temperature Tv (° C.) in the above-mentioned vulcanization conditions is adjusted in the above-mentioned range by adjusting the heating temperature of the heat roller 1. For example, in the case of the heat roller 1 which is a system of heating by heated steam, the temperature of the heated stream may be adjusted in the above-mentioned range.

The vulcanizing time is defined by the distance at which the intermediate member 3 is pressed against the heating roller 1 and the rotational speed of the heat roller 1. The distance is approximately constant depending on the size of the continuous vulcanizer and cannot be greatly changed. Therefore, the vulcanizing time may be generally adjusted by changing the rotational speeds of the heat roller 1 and the belt 2 which is rotated with the heat roller 1.

The vulcanizing pressure Pv is adjusted by changing the pressing force of the belt 2 against the heat roller 1. Specifically, by adjusting the positional relationship between the rollers 21 to 23 and the heat roller 1, or arranging a member for adjusting a tensile force of the belt 2 between the rollers 22 and 23, which is not illustrated, to change the tensile force of the belt 2 by the adjustment, the pressing force of the belt 2 against the heat roller 1 is changed, to adjust the vulcanizing pressure Pv. Further, when the felt-like belt is used as the belt 2, the vulcanizing pressure Pv is finely adjusted even by changing the specifications thereof.

As the vulcanizer, it is possible to also employ a heat press, for example, in addition to the continuous vulcanizer.

The surface of the compressible layer for a printing blanket after the vulcanization may be polished in order to adjust the surface roughness thereof, for example.

Description is now made of a printing blanket according to the present invention.

The printing blanket according to the present invention is fabricated by laminating a laminate of a compressible layer for a printing blanket made of vulcanized rubber, which is continuously produced in the above-mentioned manner, and a base fabric with the other layers constituting the printing blanket, and vulcanizing the whole of an obtained laminate.

Examples of the other layers constituting the printing blanket include various types of layers conventionally known, for example, a plurality of base fabrics or a layer of a rubber composition which forms the basis of a surface printing layer.

Examples of the base fabric include a fabric woven from cotton, polyester, rayon, or the like, as described above.

It is preferable that each of the layers is formed in a longitudinal shape corresponding to a succession of a lot of printing blankets, and is continuously laminated with the above-mentioned laminate, similarly to the above-mentioned intermediate member, considering the productivity of the printing blanket, for example.

It is preferable that the base fabrics in the layers and the above-mentioned laminate which has already been vulcanized (the laminate of the compressible layer for a printing blanket made of vulcanized rubber and the base fabric) and the base fabric are laminated through so-called vulcanization adhesives obtained by mixing ingredients such as a vulcanizing agent or a vulcanization accelerator with the above-mentioned oil-resistant rubber such as NBR or ACM, and are bonded or integrated by vulcanizing the vulcanization adhesives using overall vulcanization.

A layer of a rubber composition which forms the basis of the surface printing layer is formed by continuously applying a rubber cement obtained by melting the rubber composition in a suitable solvent, for example, on an underlay directly or continuously through the vulcanization adhesives, followed by drying, as described above.

The layer of the rubber composition is vulcanized by the overall vulcanization, and is bonded or integrated with the underlay, thereby forming a surface printing layer.

Suitably used as matrix rubber composing the rubber composition for the surface printing layer is the above-mentioned oil-resistant rubber such as NBR, CR, U or ACM. In addition thereto, hydrogenated NBR or the like is also usable. Further, a mixture of each type of rubber and sulfide rubber (T), for example, can be also used.

Ingredients for vulcanizing rubber, for example, a vulcanizing agent, a vulcanization accelerator, an activator, or a retarder are added, as described above, to the rubber composition for the surface printing layer. In addition thereto, various types of additives such as an antioxidant, a reinforcer, a filler, a softener, a vulcanizing agent, or a tackifier may be suitably mixed.

Although a curing pan may be used, as in the conventional example, for the overall vulcanization, the above-mentioned continuous vulcanizer or heat press is also preferably employed in this case in order to improve the productivity of the printing blanket as well as to fabricate the printing blanket having uniform properties which is uniformly vulcanized.

The conditions of the overall vulcanization using the continuous vulcanizer or the heat press are not particularly limited.

The reason for this is that even if the shell of each of the hollow microspheres is softened or melted or is lost by being compatible with the matrix rubber upon application of high temperature and high pressure at the time of the overall vulcanization, the matrix rubber around the hollow microsphere which has already been vulcanized to some extent by the previous continuous vulcanization hardly affects the properties of the compressible layer for a printing blanket which is incorporated into the printing blanket in order to maintain the shape of a void where the hollow microsphere has existed.

When the vulcanizing pressure at the time of the overall vulcanization is too high, the matrix rubber itself maintaining the shape of the void is collapsed, so that the void may be deformed or collapsed. Therefore, it is preferable that the vulcanizing pressure is in the range of not more than 3 $kgf/cm^2$.

If the surface of the surface printing layer is polished as required after the vulcanization, the printing blanket is fabricated.

Examples of the vulcanizing agent out of the additives added to each of layers constituting the printing blanket include sulfur, an organic sulfur compound, and an organic peroxide. Examples of the organic sulfur compound include N,N'-dithiobismorpholine. Examples of the organic peroxide include benzoyl peroxide and dicumyl peroxide.

Although an ultra-accelerator may be also used as the vulcanization accelerator, it is preferable that a general-purpose vulcanization accelerator is mainly used with the consideration of the fabrication cost of the printing blanket, since the vulcanizing temperature is high in the present invention.

Examples of the general-purpose vulcanization accelerator include organic accelerators such as thiuram vulcanization accelerators such as tetramethylthiuram disulfide and tetramethylthiuram monosulfide; dithiocarbamic acids such as zinc dibutyldithiocarbamate, zinc diethyldithiocarbamate, sodium dlimethyldithiocarbamate, and tellurium diethyldithiocarbamate; thiazoles such as 2-mercaptobenzothiazole and N-cyclohexyl-2-benzothiazole sulfonamide; and thioureas such as trimethylthiourea and N,N'-diethylthiourea, or inorganic accelerators such as calcium hydroxide, magnesium oxide, titanium oxide, and litharge (Pbo).

Examples of the activator include metal oxides such as zinc oxide, or fatty acids such as stearic acid, oleic acid, and cottonseed fatty acid.

Examples of the retarder include aromatic organic acids such as salicylic acid, phthalic anhydride, and benzoic acid; and nitroso compounds such as N-nitrosodiphenylamine, n-nitroso-2,2,4-trimethyl-1,2-dihydroquinone, and N-nitrosophenyl-β-naphtylamine.

Examples of the antioxidant include imidazoles such as 2-mercaptobenzimidazole; amines such as phenyl-α-naphthylamine, N,N'-di-N'-naphthyl-p-phenylenediamine, and N-phenyl-N'-isopropyl-p-phenylenediamine; and phenols such as di-t-butyl-p-cresol and styrenated phenol.

As a reinforcer, carbon black is mainly used. Further examples of the reinforcer include inorganic reinforces such as silica or silicate white carbon, zinc white, surface treated precipitated calcium carbonate, magnesium carbonate, talc, and clay, or organic reinforces such as coumarone-indene resin, phenol resin, and high styrene resin (a styrene-butadiene copolymer having a large styrene content).

Examples of the fillter include inorganic fillers such as calcium carbonate, clay, barium sulfate, diatomaceous earth, mica, asbestos, and graphite, and organic fillers such as asphalts, styrene resin, and glue.

Examples of the softener include various softeners of vegetable oil, mineral oil and synthetic oil such as fatty acids (stearic acid, lauric acid, etc.), cottonseed oil, tall oil, asphalts, and paraffin wax.

Examples of the plasticizer include various types of vulcanizing agents such as dibutyl phthalate, dioctyl phthalate, and tricresyl phosphate.

Examples of additives other than the foregoing include a tackifier, a dispersant, and a solvent.

As described in detail above, a compressible layer for a printing blanket according to the present invention has a uniform thickness and a uniform internal structure, thereby exhibiting superior compressibility and durability.

Further, the compressible layer can be efficiently produced in a short time, and does not require a special compound such as a ultra-accelerator; therefore, it may not reduce the productivity of a printing blanket and increase the fabrication cost thereof.

A printing blanket according to the present invention incorporates the compressible layer for a printing blanket, thereby having superior compressibility and durability.

In addition, a producing method according to the present invention can efficiently produce the compressible layer for a printing blanket.

EXAMPLES

The present invention will be described on the basis of examples and comparative examples.

Measurement of Deforming Temperature of Hollow Microspheres

Used as a hollow microsphere shall be F50D [a hollow microsphere, which has not been foamed yet, having a shell made of a copolymer of acrylonitrile and methyl methacrylate] and F50E [a hollow microsphere, which has already been foamed, having an average particle diameter of 50 μm, having a shell made of a copolymer of acrylonitrile and methyl methacrylate] which are both available from Matumoto Yushi Co., Ltd. The deforming temperature (° C.) in a case where each of the hollow microspheres was heated under atmospheric pressure was measured by the above-mentioned method using an oven.

Specifically, hollow microspheres (F50D or F50E) were weighted in predetermined amounts and were put in a tray, and the hollow microspheres, together with the tray, were put in a hot-air oven kept at a predetermined temperature, to observe every five minutes whether or not there occurred such a phenomenon that many of the hollow microspheres were aggregated or integrated by fusing by softening or melting their shells under atmospheric pressure. The above-mentioned observation was repeatedly made while changing the setting temperature of the oven, for example, 5° C. at a time (the hollow microspheres were replaced with new ones each time). The lowest temperature at which the above-mentioned phenomenon occurred was found before an elapse of thirty minutes from the time when the microspheres were put in the oven, and the temperature was taken as the deforming temperature Td (° C.).

As a result, it was confirmed that the respective deforming temperatures Td of both F50D and F50E were 120° C.

Compressible Layer for Printing Blanket

Examples 1 to 3

Preparation of Rubber Cement

The following ingredients and a suitable amount of toluene were mixed with each other, and hollow microspheres which have not been foamed yet [the above-mentioned F50D available from Matumoto Yushi Co., Ltd.], whose volume was the same as that of NBR out of the ingredients in a case where it was assumed that the particle diameter of the hollow microspheres after the foaming would be 50 μm, were added, followed by mixing, to prepare a rubber cement having the hollow microspheres uniformly dispersed therein.

| (ingredients) | (parts by weight) |
|---|---|
| NBR | 100 |
| Carbon black | 30 |
| Zinc white | 3 |
| Stearic acid | 1 |
| Plasticizer | 10 |
| Sulfur | 2 |
| Thiazole accelerator | 1 |
| Thiuram accelerator | 1 |

Preparation of Intermediate Member

The rubber cement which had been prepared as described above was continuously applied on a longitudinal strip-shaped cotton fabric, having a width of 200 cm, serving as a base fabric, followed by drying, to form a longitudinal sheet-shaped intermediate member which is a laminate of a layer of an unvulcanized rubber composition having a thickness of 0.20 mm and the base fabric.

Preparation of Compressible Layer for Printing Blanket

The intermediate member formed as described above was continuously heated at vulcanizing pressure Pv [kgf/cm$^2$] shown in Table 1 under conditions of vulcanizing temperature Tv of 150° C. and vulcanizing time of five minutes using a continuous vulcanizer having the structure shown in the Figure and having as the belt 2 a felt-like belt [made of an aramide fiber, having a thickness of 8 mm, and having a weight of 3000 g/cm$^2$ per unit area] mounted thereon in place of one made of fiber reinforced rubber with which the continuous vulcanizer was average equipped, to continuously vulcanize the layer of the rubber composition while foaming the hollow microspheres, thereby preparing a laminate of a compressible layer for a printing blanket made of vulcanized rubber and the base fabric.

Examples 4 to 7 and Comparative Example 1

A longitudinal sheet-shaped intermediate member which is a laminate of a layer of an unvulcanized rubber composition having a thickness of 0.20 mm and a base fabric, which is the same as that prepared in the above-mentioned examples 1 to 3, was continuously heated at vulcanizing pressure Pv [kgf/cm$^2$] shown in Table 2 and Table 3 under conditions of vulcanizing temperature Tv of 150° C. and vulcanizing time of five minutes using a continuous vulcanizer having the structure shown in the Figure and having as the belt 2 a belt made of fiber reinforced rubber with which the continuous vulcanizer was average equipped mounted thereon, to continuously vulcanize a layer of a rubber composition while foaming hollow microspheres, thereby preparing a laminate of a compressible layer for a printing blanket made of vulcanized rubber and the base fabric.

Comparative Example 2

A longitudinal sheet-shape intermediate member which is a laminate of a layer of an unvulcanized rubber composition having a thickness of 0.20 mm and a base fabric, which is the same as that prepared in the above-mentioned examples 1 to 3, was put in a hot-air oven kept at 150° C. in a state where it was cut to a predetermined length, and was heated for five minutes under atmospheric pressure, to vulcanize the layer of the rubber composition while foaming hollow microspheres, thereby preparing a laminate of a compressible layer for a printing blanket made of vulcanized rubber and the base fabric.

Comparative Examples 3 and 4

A longitudinal sheet-shaped intermediate member which is a laminate of a layer of an unvulcanized rubber composition having a thickness of 0.20 mm and a base fabric, which is the same as that prepared in the above-mentioned examples 1 to 3, was wound twenty times around a metal drum having a diameter of 1.5 m, was put in a curing pan, and was heated under conditions of pressure of 2 kgf/cm$^2$, terminus temperature of 150° C., and vulcanizing time of five hours, to vulcanize the layer of the rubber composition while foaming hollow microspheres, thereby preparing a laminate of a compressible layer for a printing blanket made of vulcanized rubber and the base fabric.

A starting portion of winding around the metal drum (an innermost layer) and an ending portion of the winding (an outermost layer) in the above-mentioned laminate were respectively taken as a comparative example 3 and a comparative example 4.

Example 8

A laminate of a compressible layer for a printing blanket made of vulcanized rubber and a base fabric was prepared in the same manner as those in the examples 4 to 7 and the comparative example 1 except that hollow microspheres which have already been foamed [the above-mentioned F50E available from Matumoto Yushi Co., Ltd. having an average diameter of 50 $\mu$m] was used, the hollow microopheres, whose volume was the same as that of NBR out of the ingredients, were added, and the vulcanizing pressure in continuous vulcanization by the continuous vulcanizer was set to 1.5 kgf/cm$^2$.

Example 9 to 11 and comparative Examples 5 and 6

A longitudinal sheet-shaped intermediate member which is a laminate of a layer of an unvulcanized rubber composition having a thickness of 0.20 mm and a base fabric, which is the same as that prepared in the above-mentioned examples 1 to 3, was continuously heated at a vulcanizing temperature Tv (° C.) for vulcanizing time (min.), both of which are shown in Table 2, under conditions of vulcanizing pressure Pv of 1.5 kgf/cm$^2$ using a continuous vulcanizer having the structure shown in the figure and having as the belt 2 a belt made of fiber reinforced rubber with which the continuous vulcanizer was average equipped mounted thereon, to continuously vulcanize the layer of the rubber composition while foaming hollow microspheres, thereby preparing a laminate of a compressible layer for a printing blanket made of vulcanized rubber and the base fabric.

Example 12

A longitudinal sheet-shaped intermediate member which is a laminate of a layer of an unvulcanized rubber composition having a thickness of 0.20 mm and a base fabric, which is the same as that prepared in the above-mentioned examples 1 to 3, was cut to a length corresponding to one printing blanket and was heated under conditions of vulcanizing temperature Tv of 150° C., vulcanizing pressure Pv of 1.5 kgf/cm$^2$, and vulcanizing time of five minutes using a heat press, to vulcanize a layer of a rubber composition while foaming hollow microspheres, thereby preparing a laminate of a compressible layer for a printing blanket made of vulcanized rubber and the base fabric.

The following observation and measurement were made with respect to the laminate prepared in each of the examples and the comparative examples.

Observation of Appearance

The appearance, on the side of the compressible layer for a printing blanket, of the laminate prepared in each of the examples and the comparative examples was observed. It was evaluated whether or not the appearance is good from the following criteria:

E No irregularities are seen on the surface. The appearance is significantly good.

G :.Few irregularities are seen on the surface. The appearance is good.

B : Large irregularities occur on the surface. The appearance is bad.

Observation of Internal Structure

The laminate in each of the examples and the comparative examples was cut along its width, and the shape of a void, for example, on its cut surface was particularly observed by a microscope. It was evaluated whether or not the uniformity of the internal structure is good by the following criteria:

E : The void is spherical, and the size thereof is very uniform. The internal Structure is significantly good.

G : The void is spherical, and the size thereof is almost uniform. The internal structure is good.

SB : A part of the void is deformed, and the size thereof is non-uniform. The internal structure is bad.

B : The void is deformed or collapsed. The internal structure is significantly bad.

Measurement of Difference in Thickness

The thickness, along the width, of the laminate in each of the examples and the comparative examples was measured at 100 mm spacing. The difference between the maximum value and the minimum value of the thickness was found, to evaluate the uniformity of the thickness.

The results of the above-mentioned measurements were shown in Tables 1 and 2. Reference characters in a column "vulcanization system" in the following tables respectively indicate the following vulcanization systems:

OV : Oven vulcanization

CVF : Continuous vulcanization using a felt-like belt

CVR : Continuous vulcanization using a belt made of fiber reinforced rubber

HP : Heat press

KV : Can vulcanization

As can be seen from the result of the comparative example 5, when the vulcanizing temperature Tv was higher than the deforming temperature Td (° C.) of the hollow microspheres by 50° C. or more, the hollow microspheres were deformed or collapsed by heating at a high temperature and for a long time, so that a printing blanket having a uniform porous structure could not be fabricated even if the continuous vulcanizer was used.

TABLE 1

| | | Comp. Ex. 2 | Ex. 1 | Ex. 2 | Ex. 3 | Ex. 4 | Ex. 5 | Ex. 6 | Ex. 7 | Comp. Ex. 1 |
|---|---|---|---|---|---|---|---|---|---|---|
| Vulcanizing pressure Pv [kgf/cm$^2$] | | 0 | 0.05 | 0.1 | 0.2 | 0.3 | 0.5 | 1.5 | 2.5 | 3.5 |
| Vulcanizing temperature Tv (° C.) | | 150 | 150 | 150 | 150 | 150 | 150 | 150 | 150 | 150 |
| Vulcanizing time (min) | | 5 | 5 | 5 | 5 | 5 | 5 | 5 | 5 | 5 |
| Vulcanization system | | OV | CVF | CVF | CVF | CVR | CVR | CVR | CVR | CVR |
| Appearance | | B | E | G | G | G | G | G | G | G |
| Internal structure | | SB | E | G | G | G | G | G | G | B |
| Thickness (mm) | Max. | 0.60 | 0.52 | 0.50 | 0.49 | 0.49 | 0.43 | 0.50 | 0.35 | 0.29 |
| | Min. | 0.45 | 0.51 | 0.48 | 0.47 | 0.44 | 0.40 | 0.37 | 0.31 | 0.23 |
| | Difference | 0.15 | 0.01 | 0.02 | 0.02 | 0.05 | 0.03 | 0.03 | 0.04 | 0.06 |

TABLE 2

| | | Comp. Ex. 3 | Comp. Ex. 4 | Ex. 8 | Comp. Ex. 5 | Ex. 9 | Ex. 10 | Comp. Ex. 6 | Ex. 11 | Ex. 12 |
|---|---|---|---|---|---|---|---|---|---|---|
| Vulcanizing pressure Pv [kgf/cm$^2$] | | (2.0) | | 1.5 | 1.5 | 1.5 | 1.5 | 1.5 | 1.5 | 1.5 |
| Vulcanizing temperature Tv (° C.) | | (150) | | 150 | 180 | 165 | 125 | 100 | 150 | 150 |
| Vulcanizing time (min) | | (5 hrs) | | 5 | 5 | 5 | 40 | 5 | 30 | 5 |
| Vulcanization system | | KV | | CVR | CVR | CVR | CVR | CVR | CVR | HP |
| Appearance | | G | G | G | B | G | G | G | G | G |
| Internal structure | | B | SB | G | B | G | G | SB | G | G |
| Thickness (mm) | Max. | 0.33 | 0.39 | 0.38 | 0.51 | 0.42 | 0.34 | 0.30 | 0.38 | 0.39 |
| | Min. | 0.25 | 0.33 | 0.35 | 0.41 | 0.37 | 0.32 | 0.25 | 0.34 | 0.35 |
| | Difference | 0.08 | 0.06 | 0.03 | 0.10 | 0.05 | 0.02 | 0.05 | 0.04 | 0.04 |

As can be seen from the results of the comparative examples 3 and 4 in Table 2, the porous structure of the produced compressible layer for a printing blanket greatly varied depending on a winding area in the curing pan vulcanization.

As can be seen from the results of the comparative example 2, a compressible layer for a printing blanket having a uniform porous structure could not be produced by excessive and non-uniform expansion of the hollow microspheres under atmospheric pressure.

From the result of the comparative example 1, when the vulcanizing pressure exceeded 3.0 kgf/cm$^2$, a compressible layer for a printing blanket having a porous structure with a sufficient porosity could not be produced even if the continuous vulcanizer was used.

As can be seen from the result of the comparative example 6, when the vulcanizing temperature Tv was lower than the deforming temperature Td (° C.) of the hollow microspheres, the hollow microspheres were insufficiently foamed, so that a compressive layer for a printing blanket having a porous structure with a sufficient porosity could not be produced even if the continuous vulcanizer was used.

On the other hand, from the result of each of the examples, when the vulcanization wag performed using the continuous vulcanizer or the heat press under the condition that the vulcanizing pressure Pv, the vulcanizing temperature Tv, and the vulcanizing time were in the ranges defined in the present invention, it was confirmed that a compressible layer for a printing blanket having a uniform thickness and a uniform internal structure and having a good porous structure with a sufficient porosity could be produced.

When the results of the respective examples were compared, it was confirmed that the smaller the vulcanizing pressure Pv was, the more uniform the thickness of the compressible layer and the internal structure became.

Printing Blanket

Example 13

Three cotton fabrics serving as a base fabric were laminated on a surface, on the side of the compressible layer, of the laminate produced in the above-mentioned example 1 through vulcanization adhesives having the following ingredients and a suitable amount of toluene mixed therewith:

| (Ingredients) | (Part by weight) |
|---|---|
| NBR | 100 |
| Calcium carbonate | 30 |
| Zinc white | 3 |
| Stearic acid | 1 |
| Plasticizer | 5 |
| Tackifier | 5 |
| Sulfur | 1 |
| Thiazole vulcanization accelerator | 1.5 |
| Thiuram vulcanization accelerator | 0.5 |

A rubber cement for a surface printing layer having the following ingredients and a suitable amount of toluene mixed with each other was applied to a surface, on the side of the base fabric, of the laminate, followed by driving, to form a layer of an unvulcanized rubber composition having a thickness of 0.50 mm:

| (ingredients) | (parts by weight) |
|---|---|
| NBR | 100 |
| Silica | 20 |
| Pigment | 1 |
| Zinc white | 3 |
| Stearic acid | 1 |
| Plasticizer | 10 |
| Antioxiant | 2 |
| Sulfur | 1 |
| Thiazole vulcanization accelerator | 1.5 |
| Thiuram vulcanization accelerator | 0.5 |

The above-mentioned laminate was continuously heated under conditions of vulcanizing temperature Tv of 160° C., vulcanizing time of five minutes, and vulcanizing pressure of 2 kgf/cm$^2$ using a continuous vulcanizer having the structure shown in the Figure and having as the belt 2 a belt made of fiber reinforced rubber with which the continuous vulcanizer was average equipped mounted thereon to vulcanize layers including unvulcanized rubber, thereby fabricating a printing blanket.

Example 14

A printing blanket was fabricated in the same manner as the example 13 except that the laminate prepared in the above-mentioned example 5 was used.

Operational Suitability Test

After each of the printing blankets in the above-mentioned examples 13 and 14 was mounted on a blanket cylinder of an offset rotary printing press, and was continuously used for two weeks for actual printing, the thickness thereof was measured. As a result, the thickness was hardly changed from that before the use.

In the conventional printing blanket comprising the compressible layer having an open cell structure which was formed by the above-mentioned leaching method, it is known that the thickness of a trailing edge was particularly increased by such continuous employment, resulting in interior printing. It is considered that the reason for this is that a cleaning fluid infiltrated open cells to swell the rubber.

This confirmed that both the printing blankets in the examples 13 and 14 constructed according to the present invention were superior in durability to the conventional printing blanket.

Although the present invention has been described and illustrated in detail, it is clearly understood that the same is by way of illustration and example only and is not to be taken by way of limitation, the spirit and scope of the present invention being limited only by the terms of the appended claims.

The disclosures of Japanese Patent Application Ser. Nos. 10-260299 and 11-137479, filed on Sep. 14, 1998 and May 18, 1999, respectively, are incorporated herein by reference.

What is claimed is:

1. A method of producing a compressible layer for a printing blanket, comprising the steps of:

(1) dispersing hollow microspheres each having a shell made of thermoplastic resin in unvulcanized matrix rubber, to produce a rubber composition;

(2) laminating said rubber composition on at least one base fabric, to form a sheet-shaped intermediate member;

(3) heating said intermediate member for one to fifty minutes under the following conditions of vulcanizing pressure Pv (kgf/cm$^2$) and vulcanizing temperature Tv (° C.) using a vulcanizer comprising a member for applying heat and pressure in direct contact with the intermediate member, to vulcanize the matrix rubber in a layer of said rubber composition according to the following equations:

$$0<Pv\leqq 3.0\ \text{kgf/cm}^2$$

$$Td\leqq Tv\leqq Td+50°\ \text{C.}$$

wherein Td is the deforming temperature (° C.) where the hollow microspheres are heated under atmospheric pressure without applying pressure.

2. The producing method according to claim 1, wherein a continuous vulcanizer comprising a heat roller which is rotated at a predetermined speed and a belt which is rotated in synchronization with the rotation of the heat roller in a state where it is pressed against the heat roller at predetermined pressure is used as said vulcanizer.

3. The producing method according to claim 2, wherein a belt comprising felt is used as the belt in said continuous vulcanizer, and the vulcanizing pressure Pv is not more than 0.2 kgf/cm$^2$.

4. The producing method according to claim 3, wherein the vulcanizing pressure Pv is not more than 0.07 kgf/cm$^2$.

5. The producing method according to claim 1, wherein a heat press is used as said vulcanizer.

6. The producing method according to claim 1, wherein the vulcanizing temperature Tv (° C.) is in the following range:

$$Td\leqq Tv\leqq Td+40°\ \text{C.}$$

7. The producing method according to claim 1, wherein the vulcanizing temperature Tv (° C.) is in the following range:

$$Td+10^\circ\ \text{C.}\ Tv \leqq Td+50^\circ\ \text{C.}$$

8. The producing method according to claim 1, wherein the vulcanizing time is three to forty minutes.

* * * * *

UNITED STATES PATENT AND TRADEMARK OFFICE

CERTIFICATE OF CORRECTION

PATENT NO. : 6,308,624 B1
DATED : October 30, 2001
INVENTOR(S) : Makoto Sugiya et al.

It is certified that error appears in the above-identified patent and that said Letters Patent is hereby corrected as shown below:

Title page,
Item [73], Assignee, correct the assignee's name from "Sumitomo Rubbers Industries, Limited, Hyogo (JP)" to -- Sumitomo Rubber Industries, Limited, Hyogo (JP) --.

Signed and Sealed this

Second Day of July, 2002

*Attest:*

*Attesting Officer*

JAMES E. ROGAN
*Director of the United States Patent and Trademark Office*